US005966103A

United States Patent [19]

Pons et al.

[11] Patent Number: 5,966,103

[45] Date of Patent: Oct. 12, 1999

[54] ELECTROMAGNETIC LENS OF THE PRINTED CIRCUIT TYPE WITH A SUSPENDED STRIP LINE

[75] Inventors: Patrick Pons, Rueil; Christian Renard, Boulogne, both of France

[73] Assignee: Dassault Electronique, Saint Cloud, France

[21] Appl. No.: 08/730,148

[22] Filed: Oct. 15, 1996

[30] Foreign Application Priority Data

Oct. 17, 1995 [FR] France ..... 95 12163

[51] Int. Cl.[6] ..... H01Q 15/02

[52] U.S. Cl. ..... 343/911 R; 343/753; 343/911 L

[58] Field of Search ..... 343/753, 754, 343/700 MS, 789, 909, 911 R, 911 L; H01Q 15/08, 19/03, 15/02, 15/04

[56] References Cited

U.S. PATENT DOCUMENTS

| | | | |
|---|---|---|---|
| 3,392,394 | 7/1968 | Caballero, Jr. | 343/754 |
| 3,958,246 | 5/1976 | Wohlers et al. | 343/754 |
| 4,490,723 | 12/1984 | Hardie et al. | 343/754 |
| 4,641,144 | 2/1987 | Prickett | 343/754 |

FOREIGN PATENT DOCUMENTS 2 169 453 of 1985 United Kingdom .

OTHER PUBLICATIONS

Marcuvitz, Waveguide Handbook, Radiation Laboratory Series, MIT, McGraw Hill Book Company 1951, pp. 390–393.

Oliner et al., Phased Array Antennas, 1972, A survey of Circular Symmetric Arrays, pp. 292–300. by Provencher, Artec House Inc.

Luneburg, Mathematical Theory of Optics, University of California Press, 1964, pp. v–xi and pp. 182–188.

Clapp, Extending the R–2R Lens to 360°, IEEE Transactions on Antennas and Propagation, vol. AP–32, No. 7, Jul. 1984, pp. 661–671.

Thournel, Les Antennes, Calcul Et Conception Des Dispositifs En Ondes Contimetriques Et Millimetriques, Cepadues—Editions 1990, pp. 412–419.

*Primary Examiner*—Michael C. Wimer

*Attorney, Agent, or Firm*—Pollock, Vande Sande & Amernick

[57] ABSTRACT

An electromagnetic lens comprises two conductive sides between which there is arranged a cavity provided in its lateral portion with electromagnetic input/output coupling transitions to authorize a set of propagation laws between pairs of such inputs/outputs. Moreover, it comprises, substantially centered in the cavity, a substrate comprising a printed conductive patch of predetermined dimensions, so that the two conductive sides and the patch thus create a suspended three-plate strip line structure. The content of the cavity and the respective geometries of the cavity and of the conductive patch are chosen to comply with the propagation laws.

11 Claims, 4 Drawing Sheets

ELECTROMAGNETIC LENS OF THE PRINTED CIRCUIT TYPE WITH A SUSPENDED STRIP LINE

BACKGROUND OF THE INVENTION

The invention concerns electromagnetic lenses.

There are known electromagnetic lenses which comprise two conductive sides between which there is arranged a cavity provided in its lateral portion with electromagnetic coupling transitions to authorize a set of propagation laws between pairs of such inputs/outputs.

However, the practical manufacture of such lenses poses problems, in particular for obtaining the set of propagation laws.

The present invention provides an advantageous solution for this problem.

SUMMARY OF THE INVENTION

According to one aspect of the invention the device comprises, substantially centered in the cavity, a substrate comprising a printed conductive patch of predetermined dimensions, the two conductive sides and the patch thus creating a three-plate structure with a suspended strip line, wherein the content of the cavity and the geometries of the cavity and of the conductive patch, are chosen to comply with the propagation laws.

According to another aspect of the invention, the coupling transitions are formed by horns printed on the suspended strip line, starting from its conductive patch and leading to respective transmission lines.

Very advantageously, the device comprises decoupling resistors between the printed horns constituting the inputs/outputs.

The device thus obtained comes, in a quasi-optimal way, close to the theoretical characteristics which form the advantage of electromagnetic lenses, that is to say the device has a wide operating band and a constant beam aperture.

BRIEF DESCRIPTION OF THE DRAWINGS

Other characteristics and advantages of the invention will become apparent on examining the detailed description given below, as well as the drawings wherein.

DETAILED DESCRIPTION OF THE PREFERRED EMBODIMENTS

The attached drawings are, at least in part, of a definitive nature, and it is clear that the present invention involves shapes. Consequently, and to this extent, the drawings should be considered as an integral part of the description and may not only contribute to a better understanding of the latter but also participate in the definition of the invention, if required.

In optical lenses, the function of electromagnetic lenses is to focus a plane incident wave, of a given direction, at a specific point (called the focus) of the considered direction.

Figure 1A:
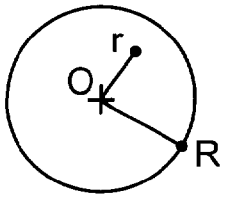
Prior Art FIG. 1A
FIGS. 1A and 1B are geometrical diagrams explaining the operation of a Luneberg lens.
Figure 1B:
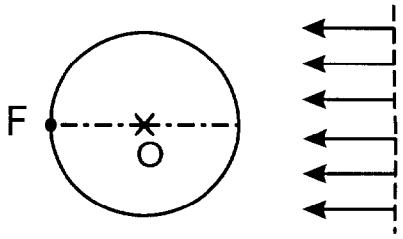
Prior Art FIG. 1B

First of all, we will consider the Luneberg lens ("Mathematical Theory of Optics", R. K. LUNEBERG, Brown University Press, 1944). This concerns a region of spherical symmetry (FIG. 1A), wherein the index n varies according to the law $$n^2(r)=2-r^2/R^2$$

where R is the radius of the region, and r the radius of the current point. A plane wave, of any direction, entering into the region will be considered. This wave (FIG. 1B) is focused at a focus F situated at the intersection of the circumference of the region with the direction of propagation of the plane wave. Such a "Luneberg lens" has, in particular, the following two properties:

it has an infinite number of focal points situated on its circumference;

if a source of electromagnetic radiation is placed at any point F on the circumference of the lens, at the output a radiating width of a dimension 2 R will be obtained.

The Luneberg lens is thus suitable for the creation of beams over 360 angular degrees. It may be the object of a spherical embodiment and above all, of a flat cylindrical embodiment. The latter makes it possible to devise in particular :

antennas with circular beam scanning by switching over 360°, with the retention of the beam width at a given frequency, or multibeam antenna systems capable of operating simultaneously along several directions, for example, for satellite transmission between mobile units.

There exist other types of electromagnetic lenses with a constrained propagation, based on different geometries and/or laws of index variations, in particular the lenses termed R2R or, more generally, RkR.

One of the theoretical advantages of these lenses is that they are capable of operating in a wideband. All the same, it is necessary that the practical embodiment of these lenses should retain these theoretical advantages.

Indeed, obtaining a continuous variation of the index industrially has been difficult.

Proposals have been made, in particular in "Les Antennes" [Antennas] of L. THOUREL, CEPADUES EDITIONS, 1988.

Figure 2:
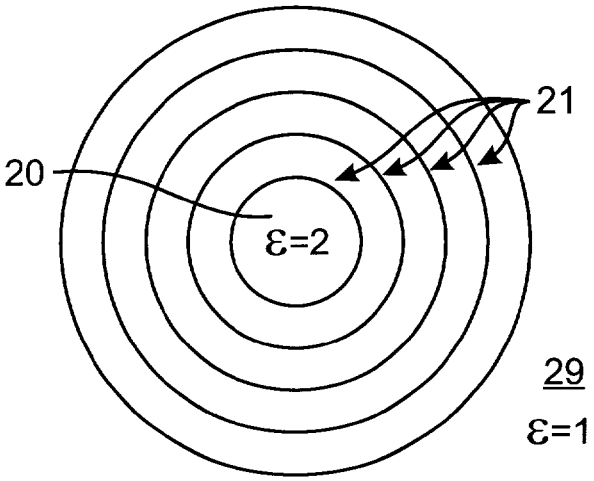
Prior Art FIG. 2
FIG. 2 illustrates an embodiment of a spherical-type Luneberg lens.

In the case of a spherical lens, the procedure generally adopted lies in creating a medium, wherein the variation of the index from the value 1 (external surface 29) towards the value 2 (center) is effected in stages, starting with a sphere 20 with the index 2 at the center, and concentric shells 21, each with a constant index (FIG. 2).

Although these performances are diminished because of the formulation of an index variation law that is not really continuous, this procedure is considered as quite distinctly preferable to attempts at creating a continuous variation of the index, which would then stipulate the intervention, for example, of a density weighting of a polystyrene, or a weighting with a polyethylene that is, for example, charged to a greater or lesser extent with particles. Indeed this often leads, as compared with the nominal law, to index deviations which are just as much of a nuisance as the deterioration of the performances due to the variation of the index by stages (better controlled), illustrated in FIG. 2.

In the case of a flat lens, it is possible to proceed as with a spherical lens by providing concentric rings of different indices, which poses the same problems, as before, of the limitation of the performances. To this there is added the fact that the collection of the energy by horns is not optimal.

Figure 3A:
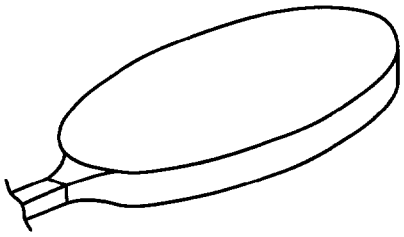
Prior Art FIG. 3A
FIGS. 3A and 3B respectively illustrate in a schematic view and in cross-section, another embodiment of a Luneberg lens, in a flat, cylindrical version.
Figure 3B:
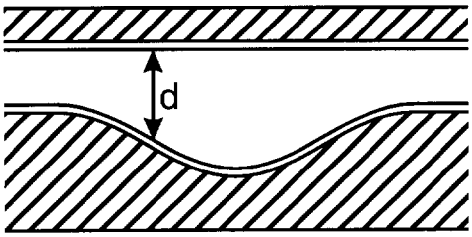
Prior Art FIG. 3B

Another procedure lies in varying the guided wavelength of a wave that is propagated between two metal plates, which is reflected in a variation of the equivalent index of the guide. In the example of FIGS. 3A and 3B, this is obtained by causing the distance d between two plates to vary, at the point where an electromagnetic wave is propagated in the TE mode.

The advantage of this method lies in the possibility of creating a closed metal wafer provided with wave guide elements at its inputs and outputs (a horn). On the other hand, a considerable drawback lies in the difficulty of machining the hollow metal plates. Another drawback is due to the limitation of the operating band, which is due to the propagation in the TE mode.

The present invention aims to propose a more satisfactory design.

Before starting the description of the invention, reference will be made to the known three-plate type propagation medium (a strip line) which basically consists of a strip-type conductor held between two conductive plates.

Figure 4A:
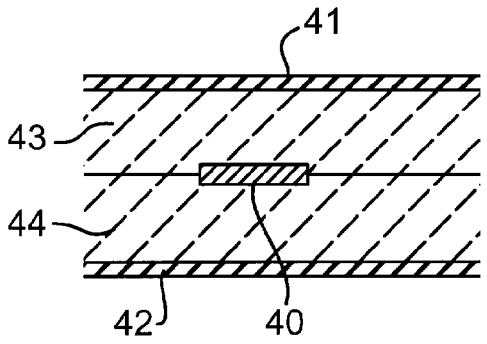
Prior Art FIG. 4A
FIGS. 4A and 4B respectively illustrate two known embodiments of electromagnetic transmission lines of the three-plate type, and with a suspended strip line.

A conventional version, where small dielectric plates are provided between the central strip 40 and the end plates 41 and 42, is illustrated in FIG. 4A. For a conventional line operating in the TEM propagation mode, the guided wavelength is $$\lambda_g=\lambda_o/\sqrt{\epsilon}$$

where $\lambda_o$ is the wavelength in air and $\epsilon$ is the relative permittivity of the dielectric between the dielectric plates 43 and 44.

Figure 4B:
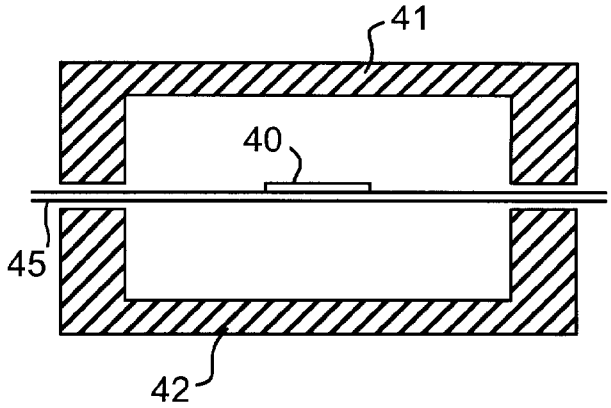
Prior Art FIG. 4B

A propagation line of the suspended substrate (or suspended strip line type) as illustrated in FIG. 4B, is a particular type of the three-plate line, where the metal strip constituting the central conductor 40 is obtained by printing on a thin dielectric film 45, using technology of the printed circuit type. It has been observed that this type of structure combines the qualities of reduced losses and a high power level.

It will also be noted that in FIG. 4B the lateral extensions of the end plates 41 and 42 serve to hold the substrate film 45.

According to the present invention, an electromagnetic lens (in the example chosen for this detailed description, a Luneberg lens) is obtained from a propagation medium of the three-plate type with a strip line suspended between two metal plates which are here planar, by causing the propagation speed of the wave to vary on the basis of the variation of the relative permittivity of the dielectric between the two metal plates.

The variation of the permittivity is, in this example, obtained on the basis of the variation of the relative dosage (sizes) of two dielectric materials with a different permittivity by following the Luneberg law. Since the propagation of the electromagnetic waves will, in principle, be effected in the TEM mode (which permits a wideband operation), the proposed device retains the particularly advantageous wideband properties.

More precisely (FIG. 5A), the proposed Luneberg lens comprises in its central portion a printed metal disk 50 placed at the center of a cavity of cylindrical symmetry, on a substrate 55 of a small thickness.

Two plane metal plates 51 and 52 create the rest of the three-plate structure, one on each side of metal disk 50, preferably forming a casing.

In the gap between the substrate 55 and the plates 51 and 52, the cavity comprises:

on the one hand a dielectric, such as air, whose relative permittivity is close to 1, on the other hand, on either side of the central circular patch 50, and preferably symmetrically relative to the patch, two dielectric wafers 56, 57 whose permittivity is higher than 2. These wafers can be made, for example, of Teflon or Stycast (Trade Marks). These wafers are preferably bonded on either side of the substrate.

The law for the wafer thickness is calculated in such a way that the relative permittivity of the propagation medium follows the Luneberg law.

In a simple embodiment, the two dielectric wafers are identical and have a permittivity $\epsilon_2$.

For a given radius r (FIG. 5B), the relative permittivity $\epsilon_r$ may be defined by the following approximate relation:

$$\epsilon_r = \frac{\epsilon_1 \cdot D1 + \epsilon_2 \cdot D2}{D1 + D2}$$

In the chosen example where the other dielectric is air, $\epsilon 1$ is equal to 1.

Of course, this simplified embodiment is only given by way of example, and it is possible to devise the same system in which the characteristics of the geometry and of the nature of wafers differ, amongst themselves and in relation to the size of the conductive patch 50.

Other indications regarding the calculation of the properties of wave guides partly filled with dielectrics will be found in the work of N. MARCUVITZ, "Waveguide Handbook", McGraw-Hill, 1951, pages 392 et sec.

Figure 5A:
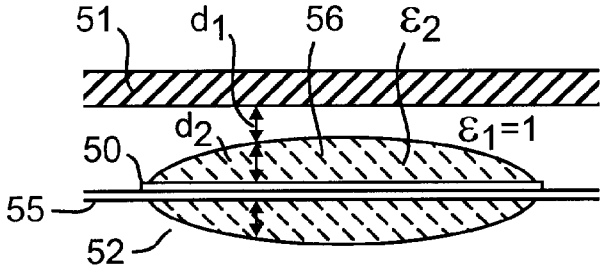
FIGS. 5A and 5B schematically illustrate the principle of the lens improved in accordance with the present invention.
Figure 5B:
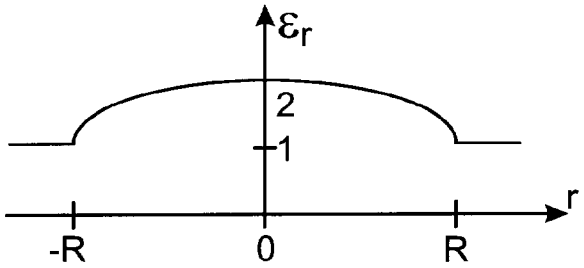
Figure 5C:
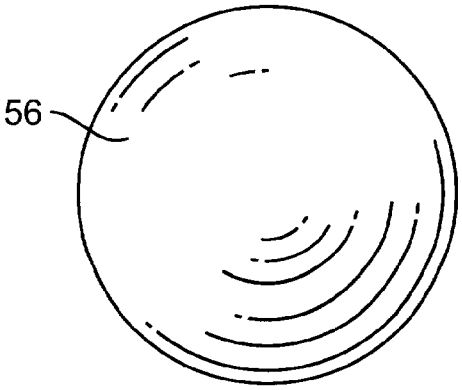
FIG. 5C illustrates a dielectric wafer of FIG. 5A in a top view.

FIG. 5C illustrates the wafer 56 (or 57) of FIG. 5A in a top view.

Figure 6:
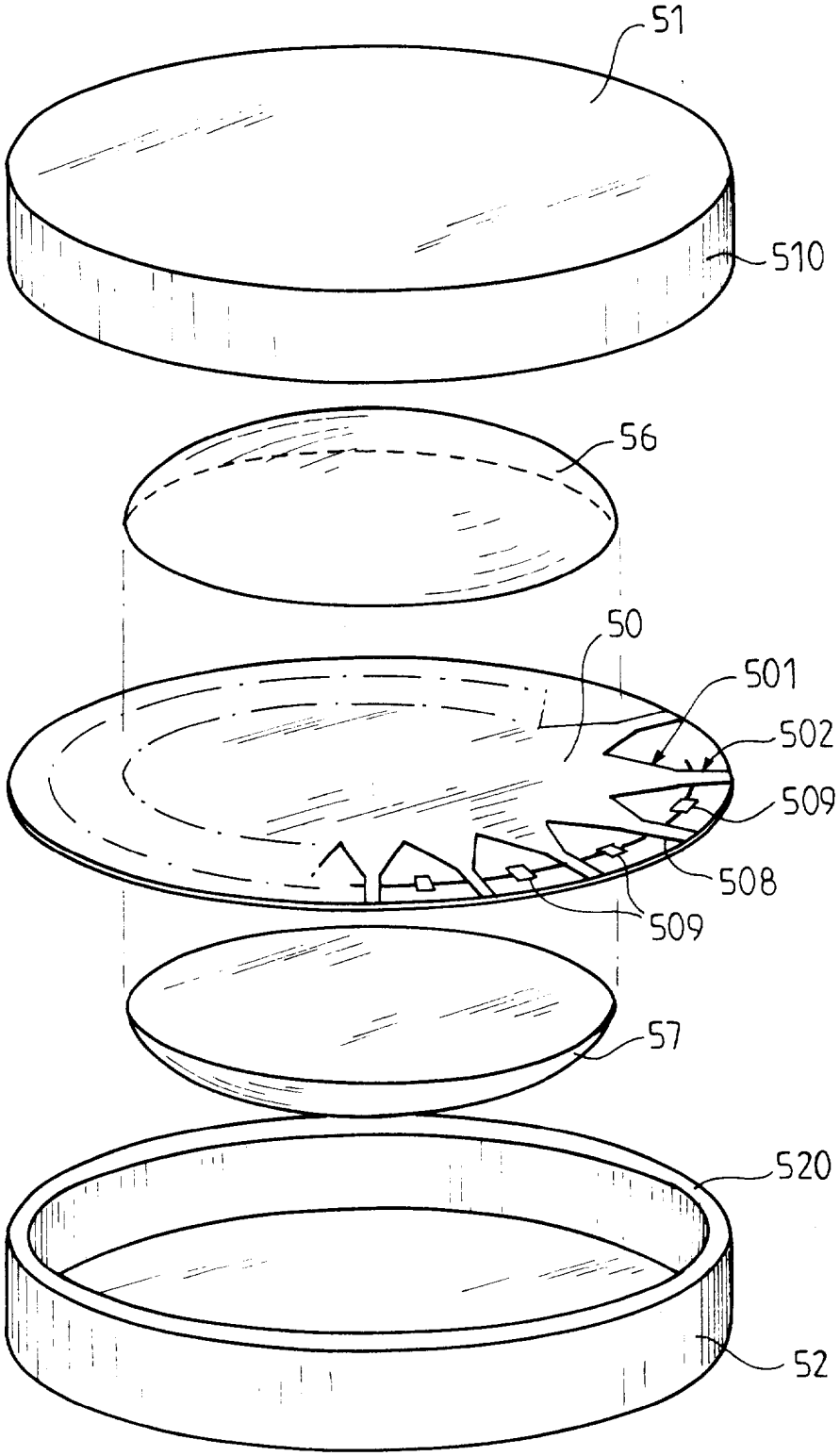
FIG. 6 is a view before mounting of the main elements of a lens in a preferred embodiment of the present invention.

A more complete embodiment is illustrated in FIG. 6.

The dielectric film 55 which has a circular shape and coaxially supports a central conductive disk 50 will again be found at the center. The electric wafers 56 and 57 are bonded on either side of this disk. The casing is closed by the two half-casings 51 and 52. In the casing 52, it will be seen that this is internally hollow, and has a side wall 520 coming to bear on the vicinity of the film 55, just like the corresponding wall 510 of the disk 51.

The input/output transitions of the lens are obtained by horns, such as 501, with a decreasing size starting from the central disk 50, and ending at a transmission line 502 whose impedance is, for example, 50 Ohms.

In this way, it is possible, according to requirements, to obtain a large number of transitions around the central disk 50 in a regular or irregular manner.

Instead of the transmission lines with an impedance of 50 ohms, it is of course possible to provide coaxial connectors, fixed to the metal plates 51 and 52 serving to hold the substrate 55.

Preferably resistors may be added between the different access points, such as 502 and 508, by providing printed resistors on the substrate 55. Such a resistor is illustrated in FIG. 6 and bears the reference numeral 509. This makes it possible to increase the decoupling between these access transitions, which then become much better than that which can be obtained with the existing technologies.

Moreover, subject to being suitably positioned, and having sufficiently high values (of the order of 200 ohms), these resistors make it possible to increase the operating frequency band of the lens by the expedient of an improvement of the stationary wave rate (or more generally of the adaptation) of each feeding horn, as well as by the elimination of distortions produced by the undesirable couplings between adjacent horns at the transmission level between input and output channels.

Thus the present invention makes it possible to obtain a planar wideband Luneberg lens made on the basis of printed technology of the type comprising a strip line suspended between two parallel metal plates, where the variation of the index of the medium, in which the electromagnetic wave is propagated, is obtained by the positioning of dielectric wafers of variable thicknesses.

The fact that this makes it possible to use a propagation in the TEM mode thus obtains a proper functioning in terms of the width of the frequency band, both from the point of view of the adaptation—stationary wave rate—and from that of the transmission rate.

This aspect is further improved in the variation using decoupling resistors between the input-output transitions of the lens.

Moreover, the present invention provides a technology whose operation is remarkably simple since it uses base materials with a constant electrical permittivity, capable of manufacture by moulding or injection, in particular as regards the wafers, while ensuring that a continuous variation of the index is obtained.

Moreover, the fact that the lens is based on printed circuit-type technology facilitates the connection to the user circuits which will also be in a printed technology, or towards coaxial connectors that are conventionally used for ultrahigh frequency circuit casings.

The printed technology also permits the use of mixed technologies in relation to fields which are, on the one hand, that of ultrahigh frequency printed circuits (decoupling resistor) and, on the other hand, that of antennas (an evolutive printed horn feeding the lens).

Of course, the present invention is not limited to the embodiment described.

For example, the plates 51 and 52 may be metallised rather than metal.

On the other hand, the invention is not limited to structures with a spherical or cylindrical symmetry. It extends to parts of such structures, as well as to combinations of these structures or of their parts. Even more generally, it extends to any relatively thin lens structure using an index variation.

Thus there exists a great variety of lens types whose principle lies in causing the dielectric constant to vary from 1 at the edges to a value $\epsilon_c$ at the center, with the following variants:

if $\epsilon_c<2$, the focal radius is situated outside the lens, if $\epsilon_c=2$ (the case of the Luneberg lens), the focal radius is situated on the circumference of the lens, if $\epsilon_c>2$, the focal radius is situated inside the lens.

All these lenses can be made by using the improvement in accordance with the present invention.

The invention is capable of even wider applications than hitherto described.

Thus it may, in particular, extend to the case of R2R or RkR types of lenses made in a printed circuit technology. These are here, in fact, other types of lenses with a constrained propagation which, without being identical with Luneberg lenses, proceed from a geometry and considerations regarding the law of propagation, which are of the same order. More detailed indications regarding the general structure of these types of lenses may be obtained from the articles "A survey of symmetric arrays", J. H. PROVENCHER, Phased Array Antennas, Artech House, 1972, and "Extending the R2R lens to 360°", R. CLAPP, IEEE Transactions on Antennas and Propagation, vol. AP-32, No.7, July 1984.

For example, it has been possible to make R2R or RkR printed lenses having printed horns as input-output transitions, and wherein printed resistors have been added in the manner described above. Here too, improvement has been observed in the operating properties in a wide frequency band of this type of electromagnetic lens.

Figure 7:
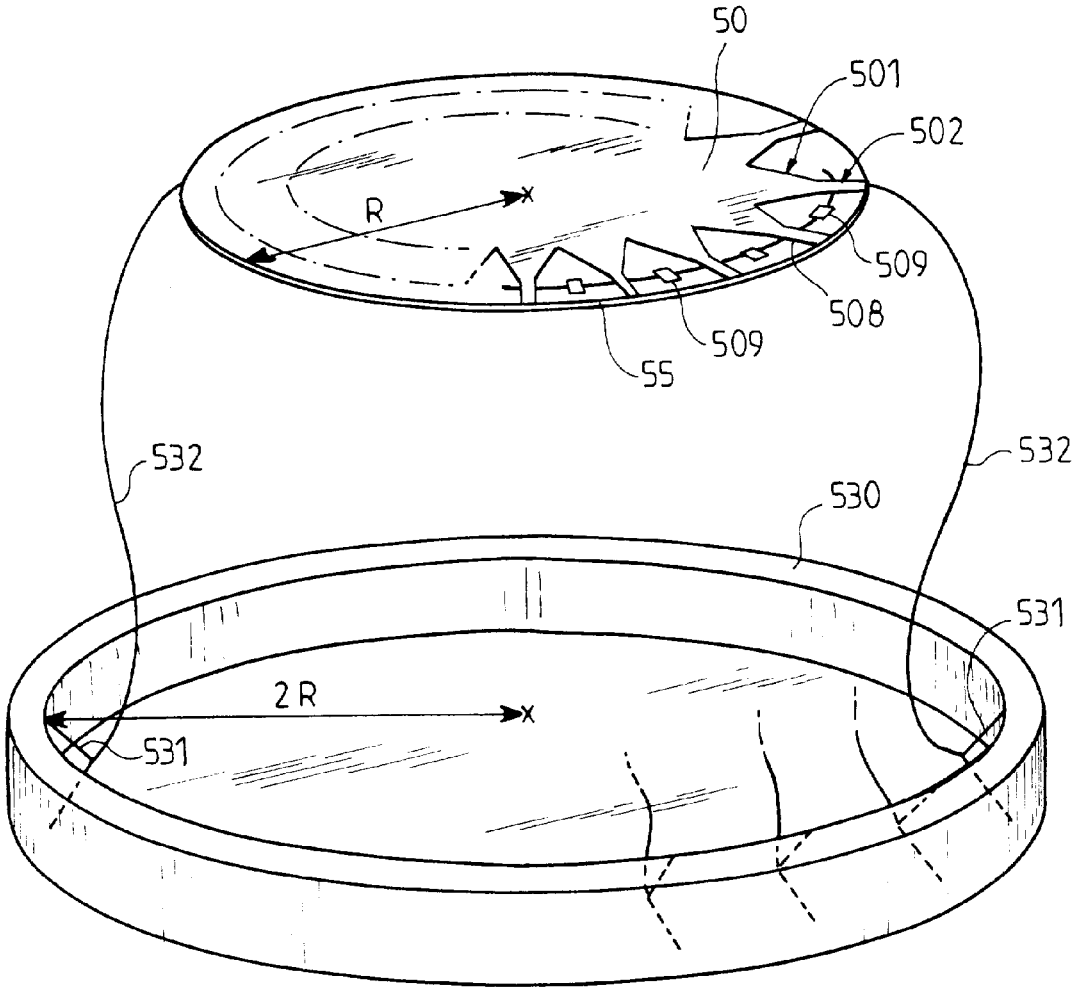
FIG. 7 is a part view of a lens in another embodiment of the present invention.

An example of the embodiment of an R2R-type lens is given in FIG. 7.

This lens comprises, substantially centered in a cavity (not shown), a substrate 55 of a small thickness on which is printed a metal disk 50 of the type described for the Luneberg lens, and having a radius R. The horns, such as 501, are connected by means of matched connecting cables 532 having identical lengths, to radiating elements 531 placed on the circumference of a wall 530, with cylindrical symmetry, of radius 2R.

The invention, of course, also makes it possible to obtain a considerable reduction of the size of the lenses as compared with the conventional solution, and also a reduction in their cost.

We claim:

1. An electromagnetic lens device comprising:

two conductive sidewalls defining a cavity arranged between said two conductive sidewalls;

a substrate substantially centered in said cavity;

a conductive patch of predetermined dimensions printed on said substrate and forming with said two conductive sidewalls a strip line with a suspended substrate;

electromagnetic coupling transition inputs and outputs printed on said suspended substrate starting from said conductive patch, each of said electromagnetic coupling transition inputs forming with one of said electromagnetic coupling transition outputs an input/output pair; and a material arranged in said cavity, wherein geometries of said cavity, of said conductive patch and of said electromagnetic coupling transition inputs and outputs, and said material are chosen to comply with a set of predetermined propagation laws between said input/output pairs.

2. A device according to claim 1, wherein said suspended substrate is made in the form of a thin film.

3. A device according to claim 1, wherein said electromagnetic coupling transition inputs and outputs are formed by horns printed on said suspended substrate, starting from an edge of said conductive patch and ending at respective transmission lines.

4. A device according to claim 3 further comprising decoupling resistors between said printed horns.

5. A device according to claim 1, wherein said geometry of said cavity and said material are provided for an electromagnetic propagation according to the TEM mode.

6. A device according to claim 1, wherein on both sides of said suspended substrate there are placed dielectric wafers which are shaped so as to obtain an index variation law adapted to said propagation laws.

7. A device according to claim 6, wherein said dielectric wafers are bonded on said suspended substrate.

8. A device according to claim 6, wherein said dielectric wafers are made of a material of an electrical permittivity higher than or equal to 2.

9. A device according to claim 6, wherein said dielectric wafers are identical and are mounted symmetrically relative to said suspended substrate.

10. A device according to claim 6, wherein a diameter of said dielectric wafers is substantially equal to a diameter of said conductive patch of said suspended substrate.

11. A device according to claim 6, wherein said index variation law corresponds to a Luneberg lens type.

* * * * *